US008669458B2

(12) United States Patent
Piccionelli et al.

(10) Patent No.: US 8,669,458 B2
(45) Date of Patent: Mar. 11, 2014

(54) STRINGED INSTRUMENT WITH KEYBOARD

(76) Inventors: Gregory A. Piccionelli, Westlake Village, CA (US); Michael M. Gerardi, Menifee, CA (US)

( * ) Notice: Subject to any disclaimer, the term of this patent is extended or adjusted under 35 U.S.C. 154(b) by 0 days.

(21) Appl. No.: 12/660,038

(22) Filed: Feb. 18, 2010

(65) Prior Publication Data

US 2010/0307314 A1 Dec. 9, 2010

Related U.S. Application Data

(60) Provisional application No. 61/208,140, filed on Feb. 20, 2009.

(51) Int. Cl.
*G10D 3/00* (2006.01)
*G10D 3/16* (2006.01)

(52) U.S. Cl.
USPC ..... 84/622; 84/291; 84/429; 84/644; 84/320

(58) Field of Classification Search
USPC ..... 84/622
See application file for complete search history.

(56) References Cited

U.S. PATENT DOCUMENTS

| | | | | |
|---|---|---|---|---|
| 3,991,646 | A * | 11/1976 | Kakehashi | 84/672 |
| 4,120,227 | A * | 10/1978 | Bolanos | 84/320 |
| 4,156,380 | A * | 5/1979 | Fulton | 84/171 |
| 4,304,167 | A * | 12/1981 | Tait | 84/429 |
| 4,658,690 | A * | 4/1987 | Aitken et al. | 84/629 |
| 5,691,490 | A * | 11/1997 | Williams | 84/170 |
| 6,034,308 | A * | 3/2000 | Little | 84/291 |
| 6,111,179 | A * | 8/2000 | Miller | 84/442 |
| 6,740,800 | B1 * | 5/2004 | Cunningham | 84/423 R |
| 7,075,001 | B2 * | 7/2006 | Williams | 84/745 |
| 2002/0100357 | A1 * | 8/2002 | Williams | 84/291 |
| 2007/0245885 | A1 * | 10/2007 | Brun | 84/745 |
| 2008/0127799 | A1 * | 6/2008 | Yamashita et al. | 84/244 |

* cited by examiner

*Primary Examiner* — Christopher Uhlir

(57) ABSTRACT

A musical instrument includes a body, a neck attached to the body, a plurality of strings having first ends secured to the body and second ends secured to the neck, and a keyboard secured to the body. Optionally, each of the strings is associated with a plucker.

15 Claims, 14 Drawing Sheets

STRINGED INSTRUMENT WITH KEYBOARD

This application is based on U.S. Provisional Patent Application Ser. No. 61/208,140, filed Feb. 20, 2009, the entire disclosure of which is incorporated herein by reference.

FIELD OF THE INVENTION

The present invention relates to musical instruments, more particular to electrified stringed instruments and keyboard instruments.

BACKGROUND OF THE INVENTION

Electric stringed instruments, such as electric guitars and electric bass guitars, are well known. Such instruments are capable of producing a wide variety of music and are useful in performing many different styles of music. Keyboard instruments, such as pianos, organs and electronic versions thereof, are also well known.

Musicians are constantly searching for new modes of musical expressions, as well as new instruments for producing and performing them. One such new instrument, the strummable electric harpsichord, disclosed and claimed in U.S. Pat. No. 6,967,270, enables a single performer to play, inter alia, electric guitar and electric bass parts using a single keyboard instrument. The '270 patent describes the use of devices ("pluckers") that pluck or strum strings of the instrument in response to commands received from a processor when one or more keys of a keyboard are depressed by a performer. The pluckers can be programmed to repeatedly pluck their associated strings at varying speeds and for varying durations.

A continuing need exists for new musical instruments that enable a performer to achieve new and unique musical and other sound effects and to do so in different and creative performance styles.

SUMMARY OF THE PREFERRED EMBODIMENTS

In accordance with one aspect of the present invention, there is provided a musical instrument including a body, a neck attached to the body, a plurality of strings having first ends secured to the body and second ends secured to the neck, and a keyboard secured to the body.

According to a particular embodiment, the neck and the body are substantially coplanar. Alternatively, according to another particular embodiment, the body includes an extension that is at least partially non-coplanar with the neck. Such extensions can be, in very particular embodiments, substantially planar extensions that join with the remainder of the body at an acute angle, or, in other very particular embodiments, a curved extension, for example an extension having a substantially circular arc as a cross-section. In still other very particular embodiments, the keyboard is secured to at least a portion of the non-coplanar extension.

In accordance with another aspect of the present invention, there is provided a musical instrument including a body, a neck attached to the body, a plurality of strings having first ends secured to the body and second ends secured to the neck, a plurality of pluckers, each string being associated with at least one plucker, and a keyboard secured to the body.

In one particular embodiment, the neck comprises a fret board comprising a plurality of sensors in a number sufficient to detect a fingering of a plurality of notes playable on the fret board. In very particular embodiments, the sensors are touch sensors.

Other features and advantages of the present invention will become apparent to those skilled in the art from the following detailed description. It is to be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The invention may be more readily understood by referring to the accompanying drawings in which

FIGS. 10*a*-12*b* illustrate alternative embodiments of musical instruments according to the invention in which a keyboard is incorporated into a non-coplanar extension of the body. In FIGS. 10*a-b* and 11*a-b*, an angled extension (FIGS.

10*a-b*) and curved extension (FIG. 11-*b*) are integrally formed with the body of the instrument, and a keyboard is included with the extensions. In FIGS. 12*a-b*, the extension is detachably secured to the body.

Like numerals refer to like parts throughout the several views of the drawings.

DETAILED DESCRIPTION OF THE PREFERRED EMBODIMENTS

In the following description, reference is made to pluckers, which are employed in embodiments of musical instruments according to the invention. Exemplary pluckers contemplated for use in embodiments of the invention are described in U.S. Pat. No. 6,967,270, to Gerardi et al., the entire disclosure of which is incorporated herein by reference. Where pluckers are described herein, their orientation can be vertical, horizontal or oblique.

Figure 1A:
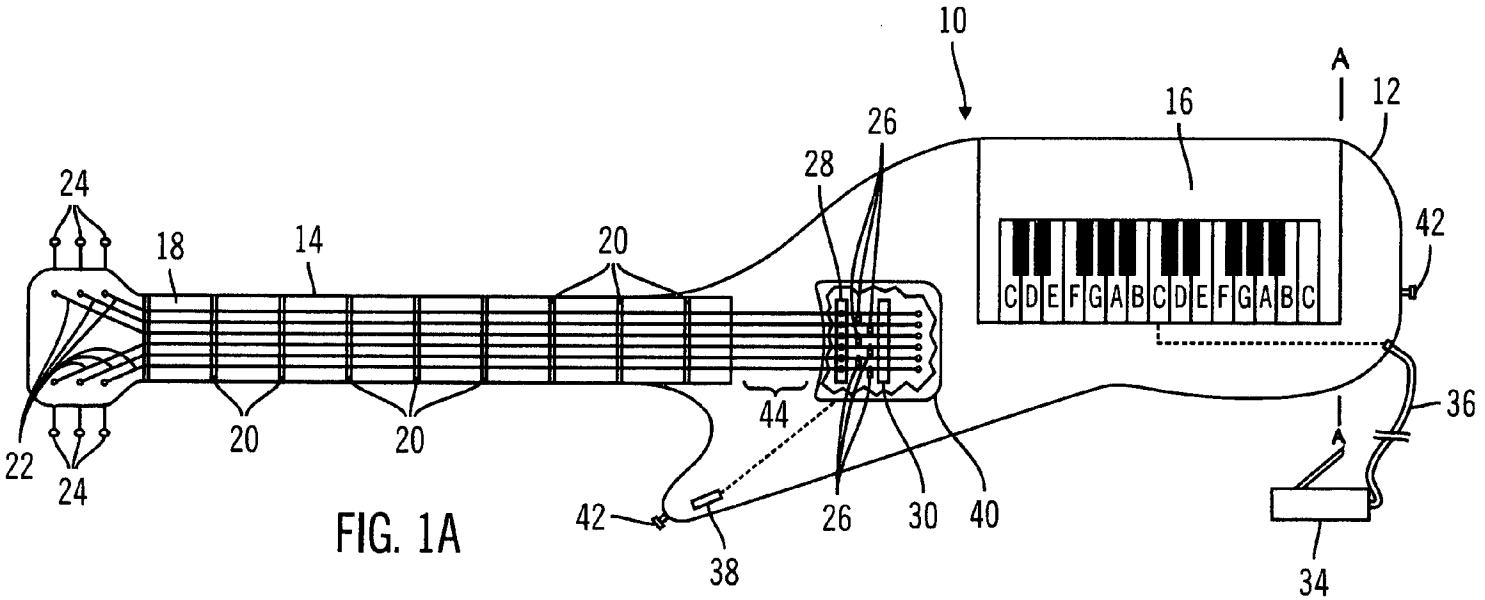
FIGS. 1*a-b* are partial cut-away top plan and side elevation views respectively of a first embodiment of a musical instrument according to the invention. The instrument includes a body, a neck attached to the body and equipped with a fret board, a plurality of metal strings each with an associated plucker, a manual strumming window, and a keyboard incorporated into the body. The player is enabled to play both the strings and the keyboard of the instrument.
Figure 1B:
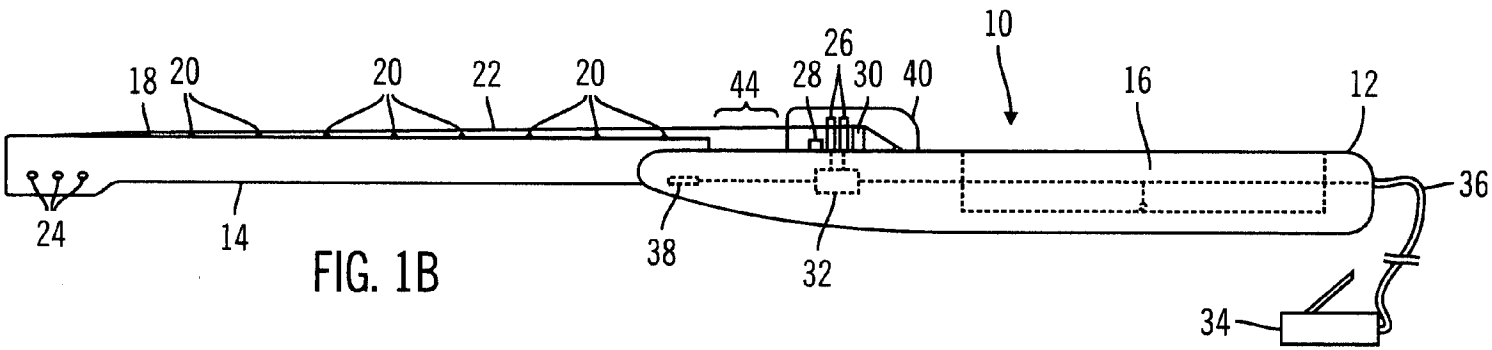

Referring to FIGS. 1*a-b*, musical instrument 10 includes body 12, neck 14 attached thereto, and keyboard 16 incorporated into body 12. Neck 14 is equipped with fret board 18 having a plurality of frets 20. Instrument 10 further includes a plurality of strings 22, typically metal strings as used in conventional electric guitars or other electrified instruments, each string 22 being associated with tuning key 24, plucker 26 and pickup 28 and contacting bridge 30 before being secured to body 12. Processor 32 controls the activation of pluckers 26, causing strings 22 to sound musical tones in response to commands received from a user of the instrument. Such commands are provided, in various embodiments, via one or more pedals 34, which communicate with processor 32 through cables 36 or, alternatively, by means of a wireless connection 38, and/or keyboard 16. Alternatively, commands to processor 32 can be provided via a hard line or wireless connection to a remote operator, such as an off-stage support technician. Pickups 28 and keyboard 16 communicate with an audio output device, such as an amplifier and speakers via conventional means such as cables or wireless connections, either directly or via processor 32 or an independent processor, or via other intervening internal circuitry. Power is supplied to instrument 10 via a conventional electrical connection or by other known means, such as a battery pack (not shown).

In the particular embodiment illustrated in FIG. 1, protective cover 40 (shown in partial cut-away) protects pluckers 26. Strap pegs 42 provide attachment points for a strap to help support musical instrument 10 during use by a player.

Musical instrument 10 affords a player a variety of performance options. First, musical instrument 10 can be played as a conventional stringed instrument, as shown as an electric guitar. The player fingers strings 22 along fret board 18, and manually strums or plucks strings 22 at manual strumming window 44 to produce desired musical notes, chords, etc. Second, musical instrument 10 can be played as a conventional keyboard instrument. The player uses one hand, or optionally both hands, to play desired notes, chords, etc. on keyboard 16.

Third, and uniquely to instruments according to the present invention, both strings 22 and keyboard 16 of musical instrument 10 can be played simultaneously by the player. Thus, for example, the player fingers one or more strings 22 with his left hand, while depressing one or more pedals 34. Depression of one or more pedals 34 activate one or more pluckers 26, which in turn sound the associated strings 22 to produce musical notes. At the same time, the player fingers keyboard 16 with his right hand to produce musical notes, chords, etc. The player thus is enabled to perform, e.g., electric guitar and electric piano notes, chords, melodies, etc. simultaneously. In effect, the inventive musical instrument provides a "third hand" to the performer.

Keyboards 16 useful in particular embodiments of musical instruments according to the invention are configured to produce a variety of sounds. As such, the terms "keys" and "keyboards" as used herein are not limited to the conventional white and black keys of a piano keyboard, but comprise any touch-sensitive elements in communication with sound-generating devices. Such depressible elements include, without limitation, white and black keys of a conventional piano keyboard, drum pads, cymbal pads, etc.

Figure 2A:
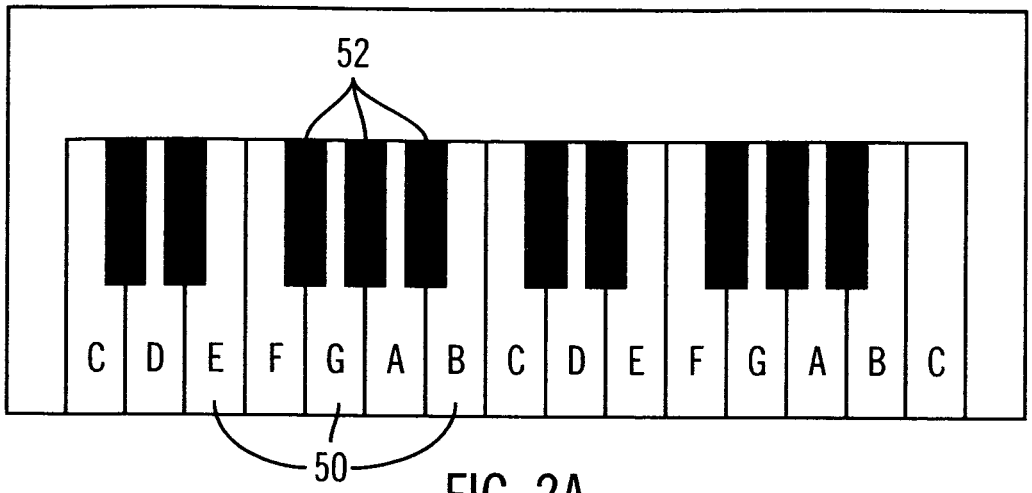
FIGS. 2*a-c* depict variant keyboards that are incorporated into particular embodiments of the invention, including keyboards solely utilizing keys for producing musical tones (FIG. 2*a*), keyboards solely utilizing pads or other elements for producing percussive and other sound effects (FIG. 2*b*), and keyboards utilizing a combination thereof (FIG. 2*c*).
Figure 2B:
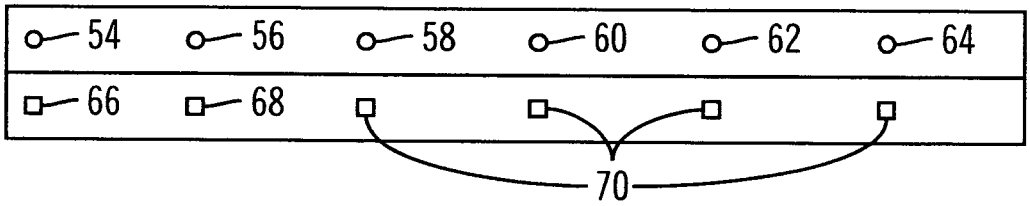
Figure 2C:
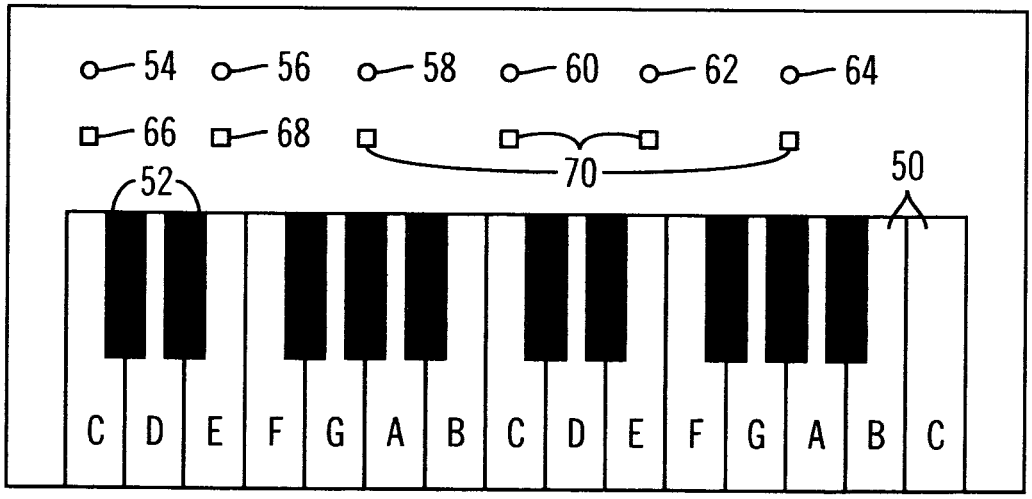

As shown in FIGS. 2*a-c*, such keyboards can comprise only keys for producing musical tones, such as conventional white keys 50 and black keys 52 (FIG. 2*a*). Other useful keyboards (FIG. 2*b*) comprise only touch-sensitive elements for sound effects, including percussive sound effects such as drum pads 54, cymbal pads 56, high hat pads 58, tambourine pads 60, cowbell pads 62, wood block pads 64, non-percussive effects such as horn pads 66, industrial sound effect pads 68, and other sound effect pads 70. Still other useful keyboards include combinations of white and black keys and additional touch-sensitive elements for producing percussive and/or other sound effects (FIG. 2*c*).

Figure 3A:
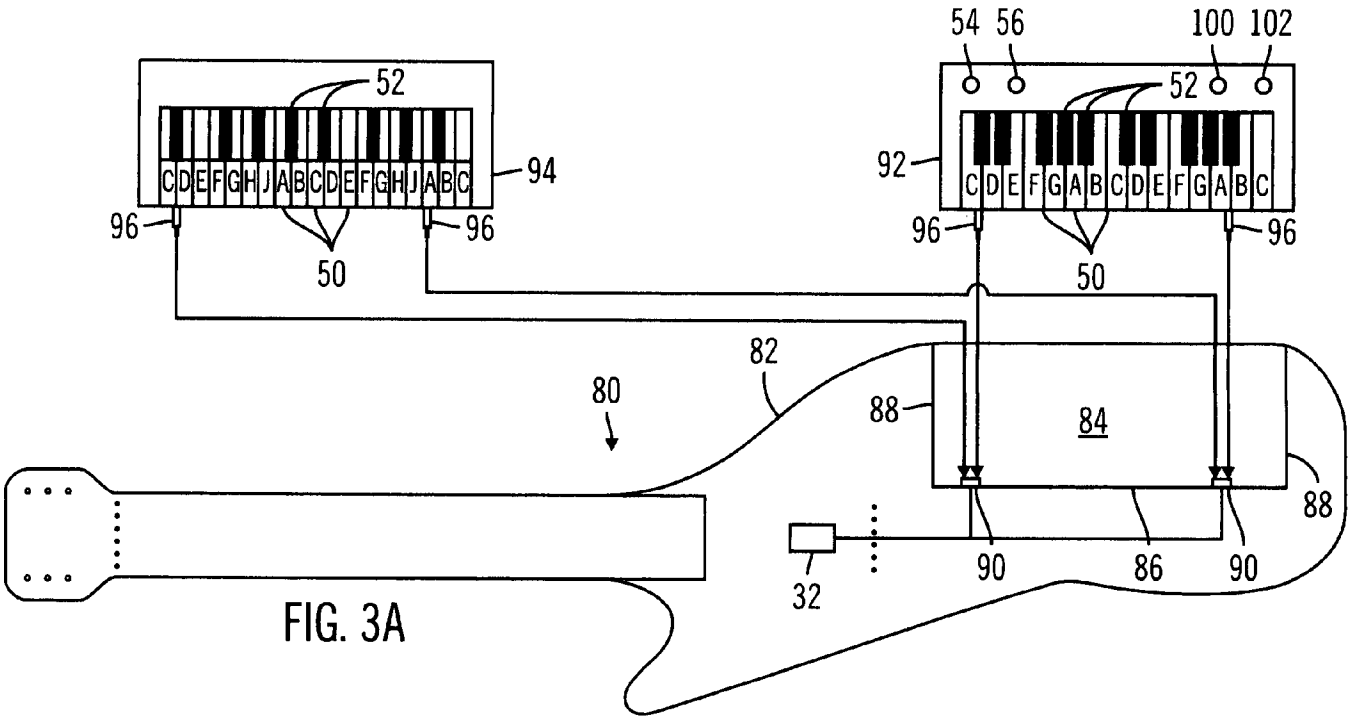
FIG. 3*a-b* are schematic top plan and side elevation views respectively of an alternative embodiment of a musical instrument according to the invention configured to utilize modular keyboard units, each keyboard being configured to produce musical tones from a different scale or tuning.
Figure 3B:
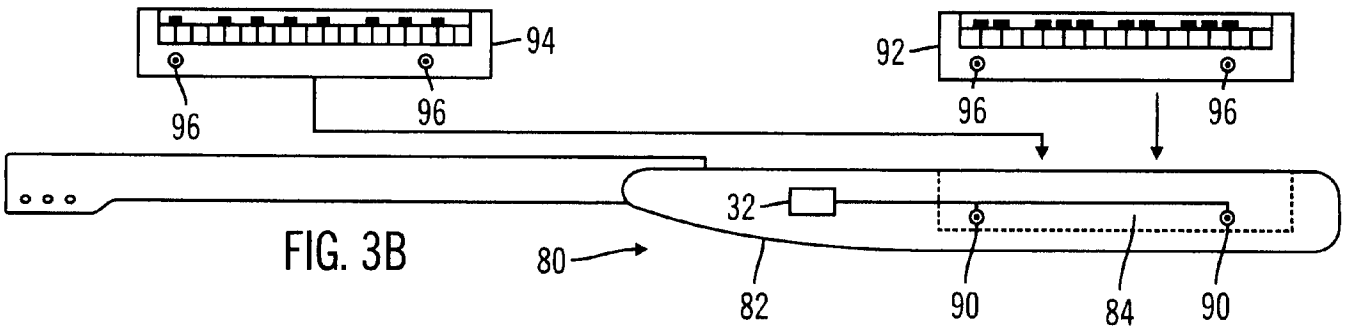

Keyboards 16 can be incorporated into body 12 in various ways. In certain embodiments, such as the embodiment of FIGS. 1*a-b*, keyboard 16 is integral with body 12, i.e., is a permanent part of body 12. In other embodiments, keyboard 16 is part of a removable modular keyboard unit. The latter embodiments afford the advantages of allowing replacement of defective or worn-out keyboard modules with newer units, or substitution of upgraded modules utilizing, e.g., improved electronics. Such embodiments also afford the use of variant keyboard configurations. Thus, as shown in FIGS. 3*a-b*, musical instrument 80 includes body 82 having defined therein keyboard bed 84 delimited by rear wall 86 and side walls 88. At least one socket 90 (two are shown) is disposed in rear wall 86 and communicates with internal elements such as processor 32 and/or external elements such as an amplifier (not shown). Modular keyboard units 92 and 94 include a plurality of white keys "ba and black keys "bb, and in particular embodiments additional drum pads 54, cymbal pads 56, etc. Each modular keyboard unit 92 further includes at least one jack 96 (two shown), each adapted to engage within a corresponding socket 90, thereby enabling communication between modular keyboard unit 92, 94 and other elements of musical instrument 80 and/or external elements.

The illustrated modular keyboard units 92, 94 are configured to produce musical tones from different scales or tunings. Modular keyboard unit 92 is configured as a conventional diatonic piano keyboard to produce musical tones of conventional major and minor scales. Modular keyboard unit 94 is configured to produce musical tones of a Bohlen-Pierce tuning, as shown tones of a C-Lambda mode.

An alternative configuration of a keyboard employed in embodiments of the invention (which can be integral or modular) is adapted to generate Shepard scales based on the particular key fingered by the player. In such an embodiment, each key is associated with a Shepard scale based on and beginning with the note corresponding to the key. For example, the key corresponding to the note $C_4$ (middle C) on a conventional diatonic keyboard is associated, in one particular alternative embodiment, with an ascending Shepard scale that begins with an low-volume (i.e., virtually inaudible) $C_4$ sounded together with a high-volume (loud) $C_5$ (an octave higher). The initial notes are then followed by a slightly louder $C\#_4$ and a slightly quieter $C\#_5$, followed by a yet louder $D_4$ and a yet quieter $D_5$, and so on, with equally loud frequencies at $F\#_4$ and $F\#_5$, finally reaching a loud $B_4$ sounded together with an almost inaudible $B_5$, with the addition of an almost inaudible $B_3$. The cycle then repeats as long as desired, for example as long as the key remains depressed. Subsequent fingering of a different key produces another ascending Shepard scale based on the note associated with the key so fingered. Such discrete Shepard scales (whether ascending or descending) are generated according to certain specific embodiments, while according to other specific embodiments the corresponding continuous scale (Risset scale, or Shepard-Risset glissando) are generated instead. Appropriate control elements, such as Shepard scale generation control switch 100, which includes positions allowing alternation between generation of single notes and Shepard scales, and ascending/descending Shepard scale generation control switch 102, are included in specific embodiments enabling Shepard scale generation.

Figure 4:
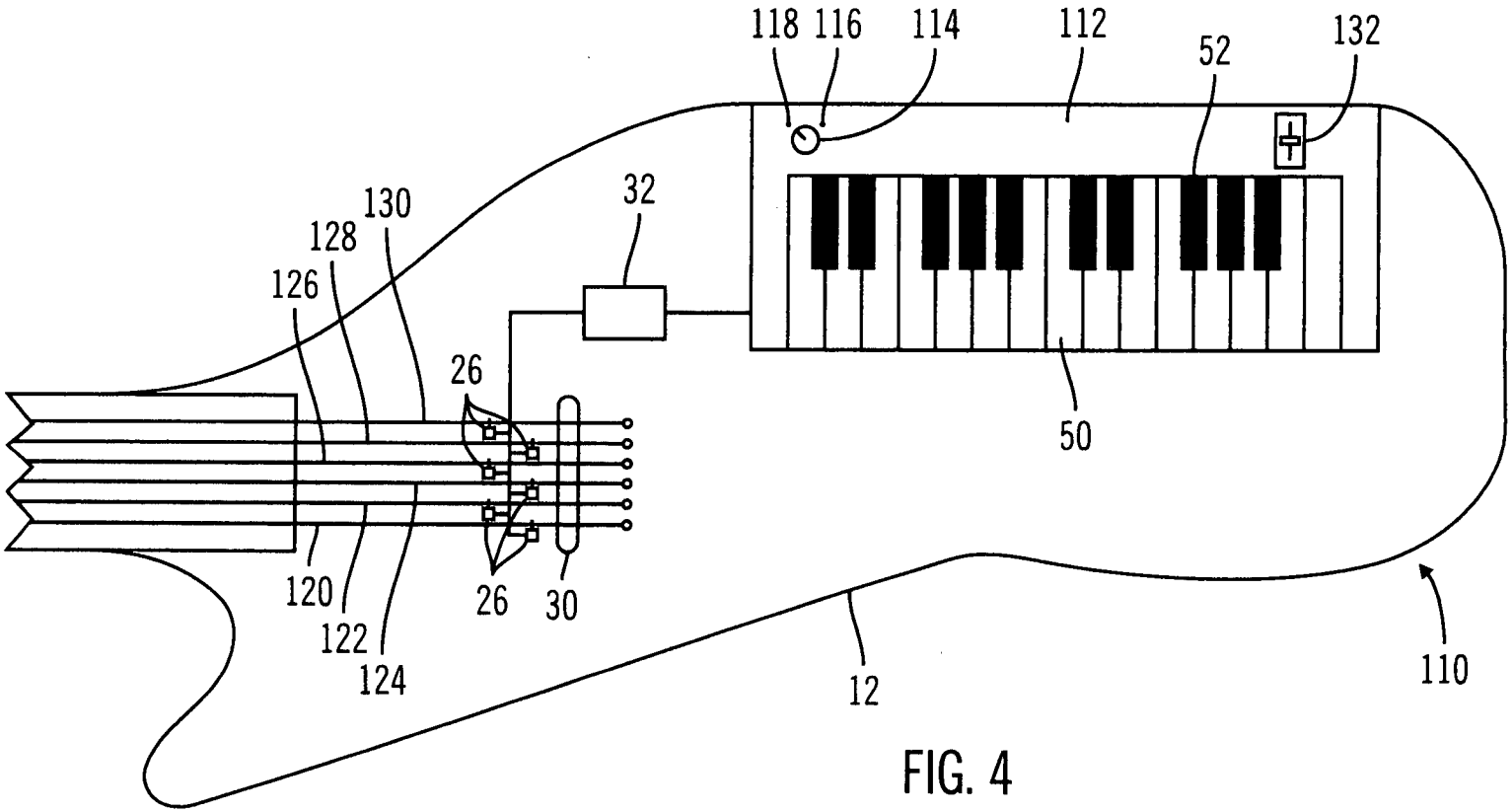
FIG. 4 illustrates a keyboard configured to produce, together with the pluckers, a range of arpeggiation patterns, Each of the keys of the keyboard is associated with a particular arpeggiation pattern; when depressed, a plurality of pluckers are activated to pluck strings associated therewith in the selected arpeggiation pattern, continuing, for example, for as long as the key is depressed, or alternatively for a pre-selected or user-determined time.

In addition to producing musical tones, some or all of the keys of a keyboard in certain embodiments of a musical instrument according to the invention can be used to control the operation of the pluckers, supplementing or replacing the operation of pedals and/or other control means. In very specific embodiments, various keys of the keyboard can be used to specify arpeggiation patterns by which strings of the instrument are plucked. Thus, turning now to FIG. 4, musical instrument 110 includes body 12 to which keyboard 112, comprising a plurality of white keys 50 and black keys 52, is secured as with preceding keyboards (i.e., integrally or removably secured). In this embodiment, however, control switch 114 includes conventional keyboard position 116 and arpeggiation position 118. When control switch 114 is set to the former position, keyboard 112 functions as a keyboard as described previously When, however, control switch 114 is set to the latter position, each key of keyboard 112 is associated with a particular arpeggiation pattern. Thus, for example, when control switch 114 is set to position 116, white key 50 is configured to produce the note $C_4$. When control switch 114 is set to position 118, white key 50 is configured to produce the arpeggiation pattern "1-3-5-3-1". When white key 50 is depressed, the pluckers 26 associated with strings 120, 124 and 128 are activated in the specified order: 120-124-128-124-120. When another key, for example black key 52, is depressed, a different arpeggiation pattern, for example 2-4-6, is selected, and the pluckers 26 associated with strings 122, 126 and 130 are activated in the specified order: 122-126-130. In particular embodiments, the selected arpeggiation pattern is continued as long as the corresponding key is depressed. In other particular embodiments, the selected arpeggiation pattern is maintained for a pre-selected duration, or for a user-determined duration, which is set, in very particular embodiments, by adjusting an associated control device 132, such as a dial, slider, etc.

Figure 5A:
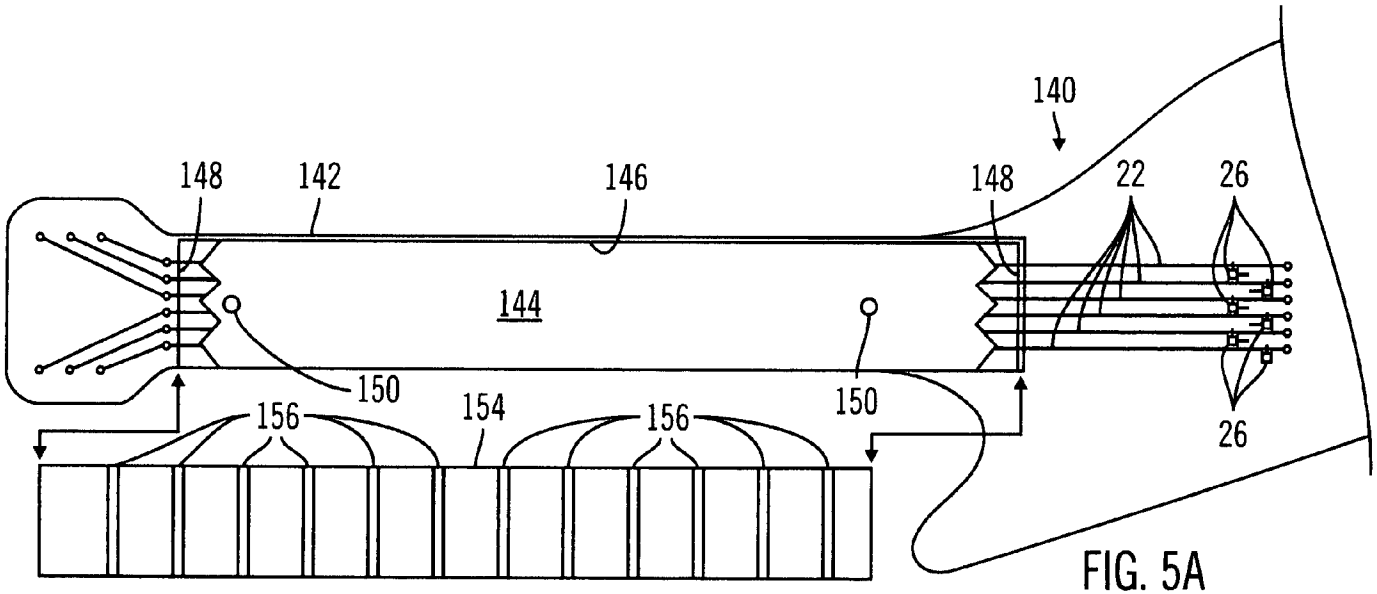
FIGS. 5*a-b* are top plan (with strings partially cut away) and side elevation views (with strings omitted for clarity) respectively of a portion of a neck of an alternative embodiment of a musical instrument according to the invention, in which the neck has defined therein a bed into which a neck insert is removably engaged. Various neck inserts are engaged within the neck bed according to particular embodiments, illustrated examples of which include fretted neck inserts and fretless, touch-sensitive neck inserts.
Figure 5B:
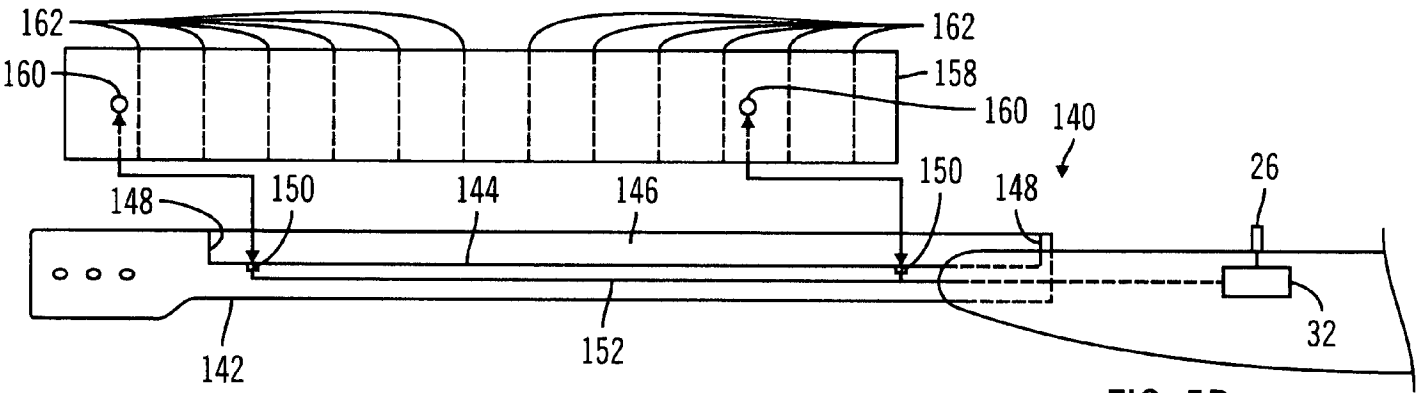

Various embodiments of musical instruments according to the invention include removable neck inserts which enable different playing styles and functions. Turning to FIGS. 5*a-b*, musical instrument 140 includes neck 142 having defined therein neck insert bed 144 surrounded by rear wall 146 and side walls 148. At least one neck insert bed contact 150 (two are shown) is disposed in neck insert bed 144 and communicates with processor 32 via neck circuitry 152. Alternatively, contacts 150 can be disposed in rear wall 146 and/or side wall(s) 148. Neck insert bed 144 accommodates a variety of neck inserts which are secured therein by conventional securing elements such as Velcro® strips, magnets, mechanical fasteners and the like.

Fretted neck insert 154 comprises a plurality of neck insert frets 156. Once secured within neck insert bed 144, fretted neck insert 154 enables a player to play strings 22 in a manner similar to a conventional stringed instrument such as an electric guitar, by fingering the strings such that contact is made with various of frets 156. If desired, frets 156 can be omitted to afford an alternative fretless neck insert.

A further alternative fretless touch-sensitive neck insert 158 comprises a touch-sensitive element, for example a touchscreen such as that used in portable telecommunication devices, and includes at least one neck insert contact 160 (two are shown) arranged such that when insert 158 is secured within neck insert bed 144 (again using any desired conventional securing elements), each neck bed contact 150 comes into contact with corresponding neck insert contact 160. Fretless touch-sensitive neck insert 158 communicates with processor 32 via contact(s) 160 and 150 and neck circuitry 152. Optionally, fret lines 162 corresponding to conventional frets are provided to insert 158 for the player's convenience.

To play this embodiment, a player fingers one or more strings as with a conventional stringed instrument. When a string 22 is fingered, touch-sensitive neck insert 158 generates a signal indicating that the fingering has occurred, and this signal is provided to processor 32. Processor 32 in turn activates the plucker 26 associated with the string 22, and the string is plucked. Multiple strings fingered simultaneously are plucked together to produce a chord, or alternatively, are arpeggiated as discussed above with respect to FIG. 4.

Embodiments of musical instruments according to the invention comprise any desired number and type of strings. Non-limiting examples include instruments utilizing six electric guitar strings, twelve electric guitar strings paired to yield six pairs of strings, and four electric bass strings. When paired strings are utilized, pluckers associated with each string in the pair can be controlled jointly by processor 32, or alternatively can be controlled individually. That is, each string of the pair can be controlled to pluck its associated string at a separate plucking frequency. For example, the second plucker of the pair can be controlled to pluck its associated string at twice the frequency of the first plucker.

Figure 6:
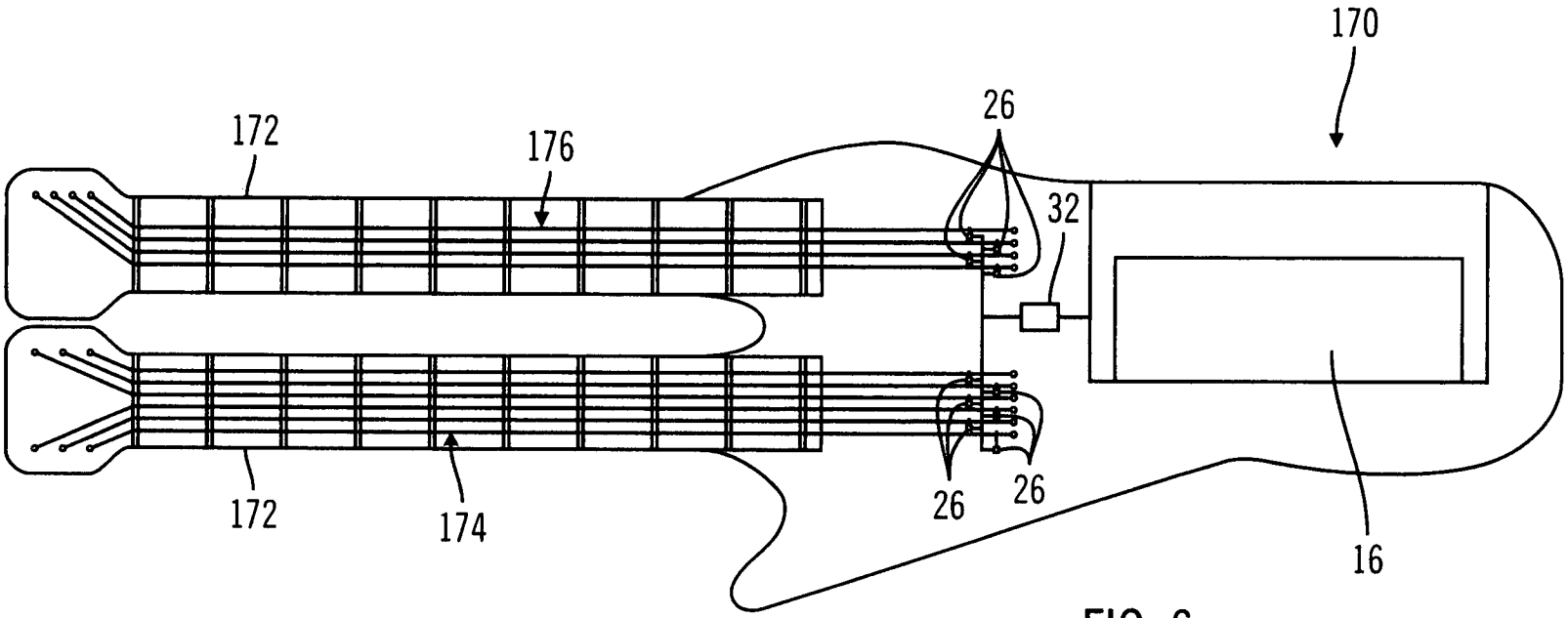
FIG. 6 illustrates an alternative embodiment configured to include two necks, thus affording the use of different string configurations, neck insert configurations, etc.

The preceding embodiments have included a single neck affixed to the body of the musical instrument. Other embodiments of musical instruments according to the invention include two (or more) necks affixed to the same body. Thus, for example, in FIG. 6 musical instrument 170 is configured to include two necks 172. In this embodiment, each neck 172 utilizes a different configuration of strings (as shown, using six-string electric guitar configuration 174 and four-string electric bass configuration 176). Different combinations of electric guitar, bass and other stringed instruments (banjos, mandolins, etc.) thus can be combined into a single instrument according to embodiments of the invention.

Figure 7B:
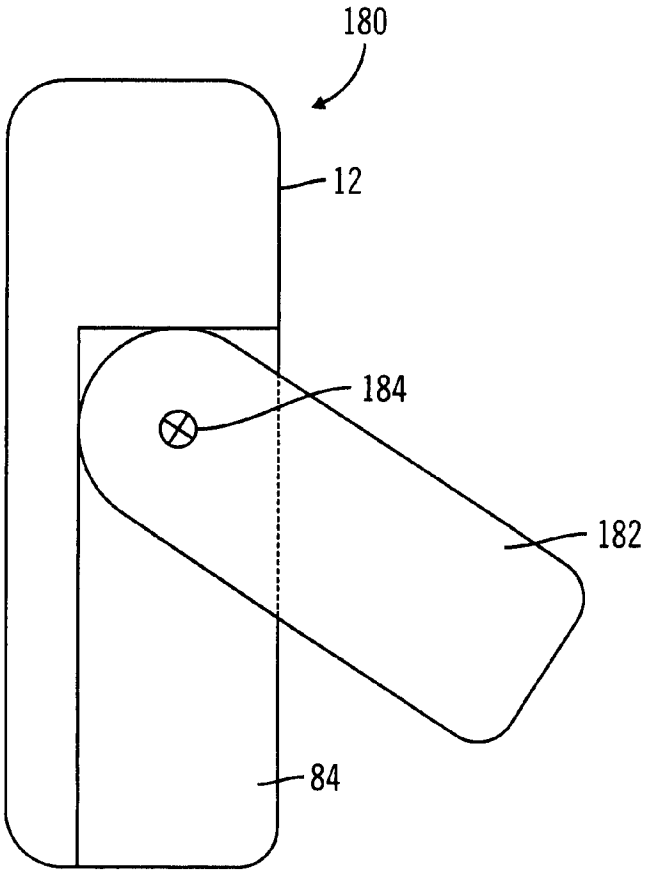
FIGS. 7*a-b* and 8*a-b* are cross-sectional views along line A-A of FIG. 1 illustrating alternative embodiments of a musical instrument according to the invention in which a keyboard is pivotably mounted within the body of the instrument, either directly (FIGS. 7*a-b*) or in conjunction with a tray assembly (FIGS. 8*a-b*).
Figure 7A:
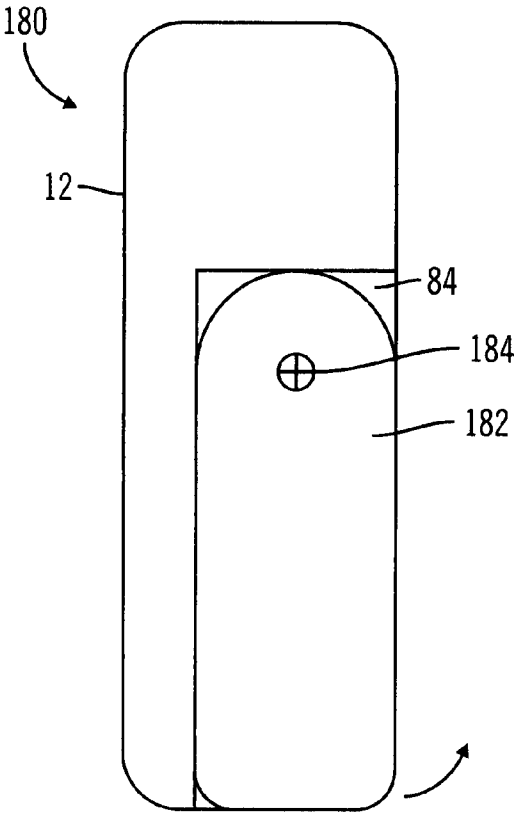

The foregoing embodiments of musical instruments according to the invention have included keyboards that are fixed in one position relative to the body, namely substantially flush with the body (herein "Slash mode"), while in use. Some players may find that other positions than the flat, fixed position are more comfortable or facilitate a different playing style. Thus, additional embodiments of the invention provide keyboards whose position relative to the body is adjustable to non-flush positions (herein "Nerd mode"). Turning now to FIGS. 7*a-b*, musical instrument 180 includes body 12 with pivotable keyboard 182 seated in keyboard bed 84 and pivotally rotatable about keyboard axis 184. Pivotal rotation can be achieved by conventional means such as by use of an axle, a pair of pivots, etc., having ends engaged in appropriate sockets or other receiving devices, and optionally including a conventional ratchet mechanism or other device for securing the keyboard in the desired Slash (FIG. 7*a*) or Nerd (FIG. 7*b*) modes.

Figure 8B:
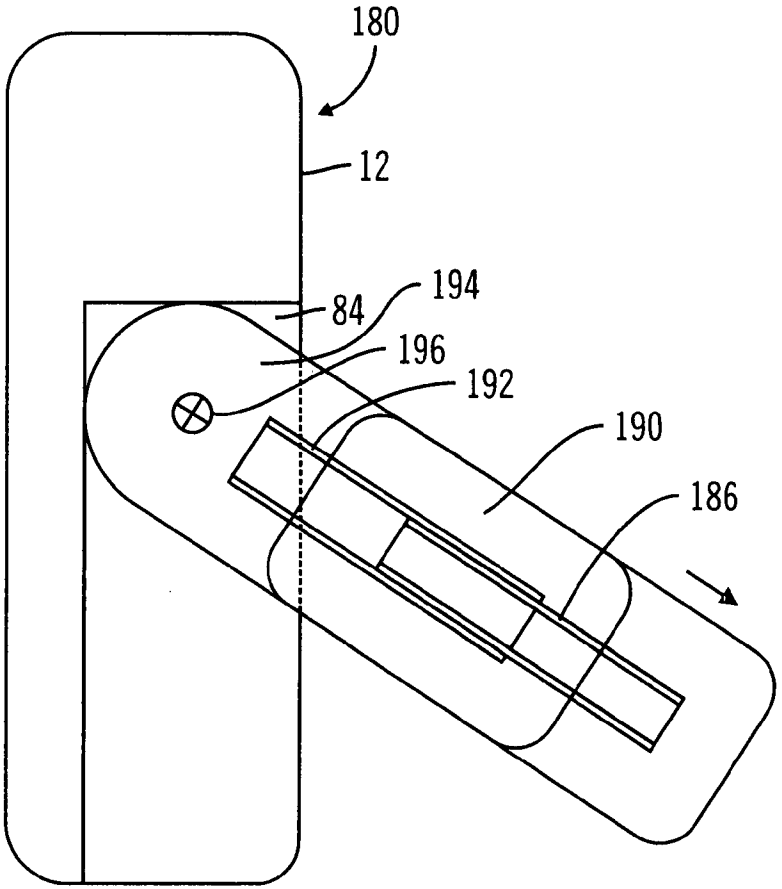
Figure 8A:
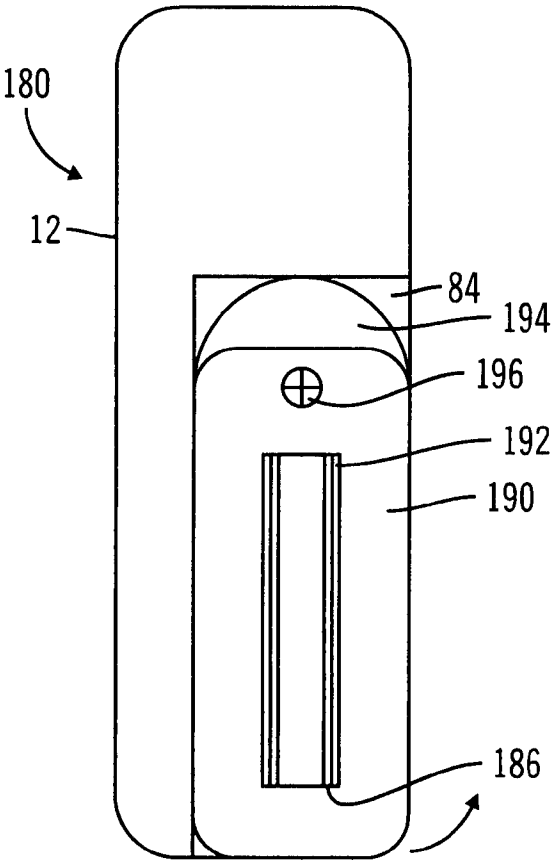

In FIGS. 8*a-b*, inner slider arms 186 are secured to sides 188 of slidable keyboard 190, and in turn engage outer slider arms 192 affixed to pivotable tray 194. Tray 194 in turn is pivotally received within keyboard bed 84 and pivots about tray axis 196. In use, tray 194 is pivoted about tray axis 196 to a desired position, at which point slidable keyboard 190 is deployed outward from body 12 within tray 194, guided by engaged inner and out slider arms 186 and 192 until the desired final position is reached. Again, conventional devices for securing the position of keyboard 182 and tray 194 with respect to tray 194 and body 12 respectively are optionally included in specific embodiments.

The embodiments illustrated in FIGS. 1-8 all utilize physical strings and keyboards. Modem developments in touch-sensitive devices and haptics make it possible to replace physical strings and/or keyboards with "virtual" equivalents. Doing so offers a number of advantages, including reduced weight, reduced number of parts, greater reliability, reduced occurrence of mechanical malfunction, and perhaps more significantly, the ability to vary the configuration of the instrument by appropriate instructions to a processor or processors, rather than by replacement of physical components with other physical components. Thus, the number and type of strings being played, the number and configuration of keys in a keyboard, the tunings of the strings and/or keyboard, the number and type of sound effects generated by one or more (virtual) keys, etc., can all be varied by means of software rather than hardware. Furthermore, the desired variations can be carried out in real time, e.g., "on the fly" during a performance, enabling the performer to quickly and easily modify the instrument to suit the needs of his performance.

Figure 9A:
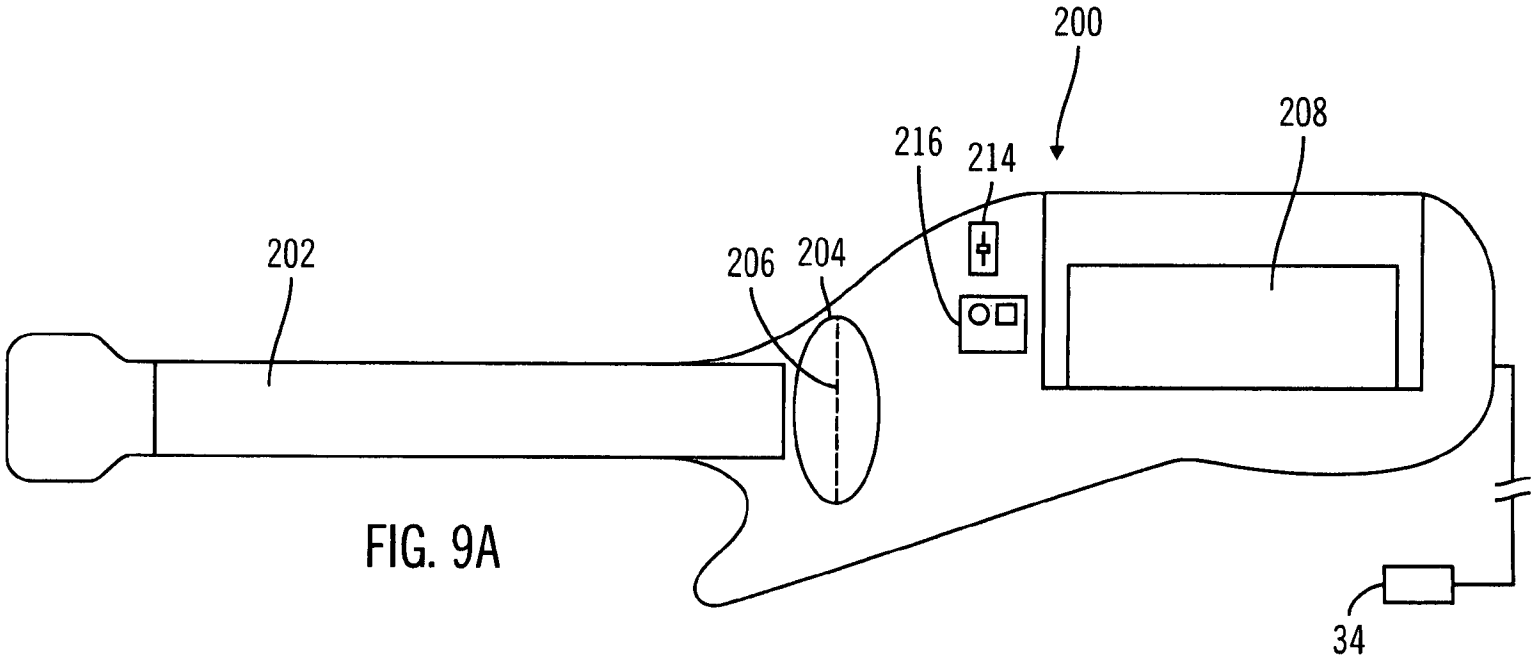
FIGS. 9*a-b* are generalized top plan and side elevation schematic representations of a musical instrument of the invention, identifying locations in which touch-sensitive elements are incorporated in various specific embodiments.
Figure 9B:
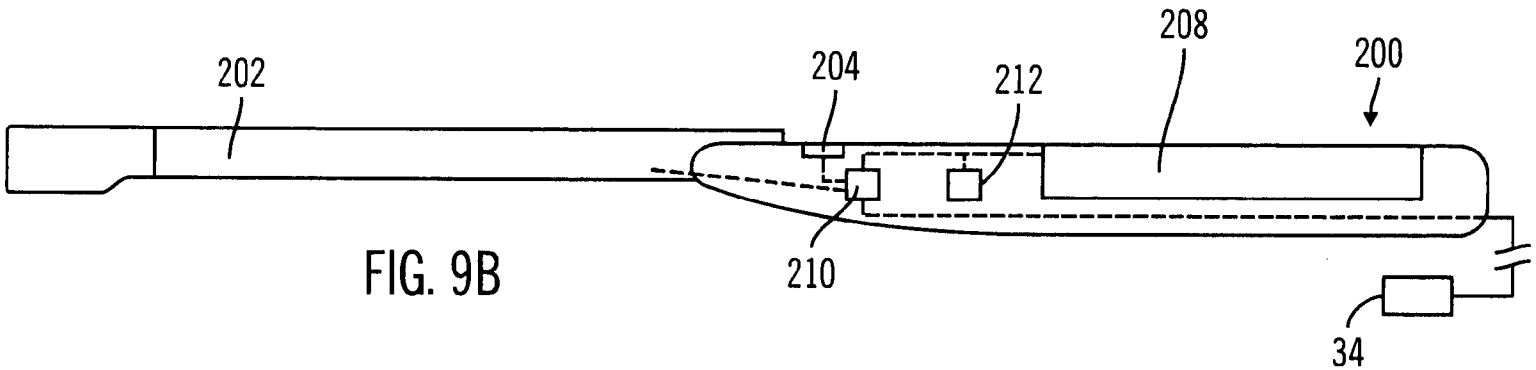

A generalized musical instrument 200 embodying touch-sensitive elements in accordance with aspects of the invention is illustrated in FIG. 9, and includes touch-sensitive neck board 202, touch-sensitive strumming window 204 having strumming axis 206, and touch-sensitive keyboard 208, together with processor 210 in communication with touch-sensitive neck board 202 and touch-sensitive keyboard 208, and sound generator 212 on communication with processor 210. In alternative embodiments, separate processors 210 are associated with touch-sensitive neck board 202 (for "virtual string" embodiments) and touch sensitive keyboard 208 (for "virtual keyboard" applications). Separate sound generators 212 for each function are also employed in alternative embodiments. Sound generator 212 directly produces audible sound in particular embodiments; in alternative embodiments, output produced by sound generator 212 is communicated to an external amplifier or other sound generating device via cable, wireless connection or other desired means.

Various exemplary specific embodiments of such musical instruments incorporate "virtual strings" together with physical strings and/or a physical keyboard, physical strings together with a "virtual keyboard", both "virtual strings" and "virtual keyboards", and any other combinations thereof.

A "virtual string" embodiment is operated as follows. A player "fingers" touch-sensitive neck board 202 as he would a conventional stringed instrument. Touch-sensitive neck board 202 detects the position(s) of contact by the player's finger(s), and conveys information pertaining to the contact to processor 210. Processor 210 uses the information so provided to determine which string or strings of a selected type of strings (e.g., electric guitar, electric bass, banjo, mandolin, etc., in a selected number, e.g., six, eight, twelve, etc.) have been fingered, and which note(s) the player intends to produce as a result of the fingering(s) so detected. Processor 210 then instructs sound generator 212 to generate the appropriate note or notes. The duration of the note(s) so produced can be specified by the player by various means, such as by use of a pedal 34, a slider 214, or other control devices, or by appropriate software instructions provided to processor 210.

Particular embodiments enable a player to determine the number and type of virtual strings in real time. In such embodiments, string configuration control unit 216 includes one or more dials, sliders, pads or other elements enabling the player to select the number of virtual strings to be played, as well as the type of strings and/or their tunings. If and when the player desires to change the string configuration, he need only adjust string configuration control unit 216 accordingly, and appropriate instructions are then provided to processor 210. Thus, for example, if the player is playing instrument 200 in a configuration using six electric guitar strings, and desires to change the string configuration to four electric bass strings, he need only adjust string configuration control unit 216 accordingly. Information received from touch-sensitive neck board 202 is then interpreted by processor 210 as pertaining to four electric bass strings rather than six electric guitar strings for determination of which string or strings are subsequently fingered and which note or notes are intended to be produced thereby.

In more particular "virtual string" embodiments, touch-sensitive strumming window 204 is employed together with touch-sensitive neck board 202. When moving contact of a player's finger(s) across touch-sensitive strumming window 204 (more specifically, by movement having at least a component directed from left to right or right to left in the direction defined by strumming axis 206 of strumming window 204), touch-sensitive strumming window 204 provides information to processor 210 pertaining to which specific virtual strings are so strummed. Together with fingering information provided to processor 210 from touch-sensitive neck board 202, the strumming information is used by processor 210 to determine which string and notes are to be sounded. Processor 210 then instructs sound generator 212 to sound the appropriate notes simultaneously, thus producing a strummed chord.

Similar principles apply in operating a "virtual keyboard" embodiment. In such embodiments, a player fingers touch-sensitive keyboard 208 as he would a physical keyboard. Touch-sensitive keyboard 208 detects the position(s) of contact by the player's finger(s), and conveys information pertaining to the contact to processor 210. Processor 210 uses the information so provided to determine which key or keys have been fingered, and thus which note(s) the player intends to produce as a result of the fingering(s) so detected. Processor 210 then instructs sound generator 212 to generate the appropriate note or notes. The duration of the note(s) so produced again can be specified by the player by various means, similar to those described previously with respect to "virtual string" embodiments. Likewise, various keyboard configurations, including octave ranges (for conventional diatonic keyboards), tritave ranges (for Bohlen-Pierce keyboards), and particular instrumental tones generated (e.g., piano, harpsichord, organ, or any other instrument capable of being synthesized), can be selected by the player and varied during performances as desired.

The preceding embodiments of musical instruments according to the invention have included bodies and necks that are substantially coplanar. Additional embodiments of musical inventions according to the invention include extensions of the body of the instrument that are at least partially non-coplanar. In more specific embodiments, the keyboard is secured to or incorporated into at least a portion of the extension. Such embodiments afford a performer an alternative keyboard location that may prove easier for the performer to use. Furthermore, the non-standard appearance of such embodiments affords the performer a new and different means of visually identifying himself, and also provides new possibilities for incorporating the shape of the instrument itself into his performance.

Figure 10A:
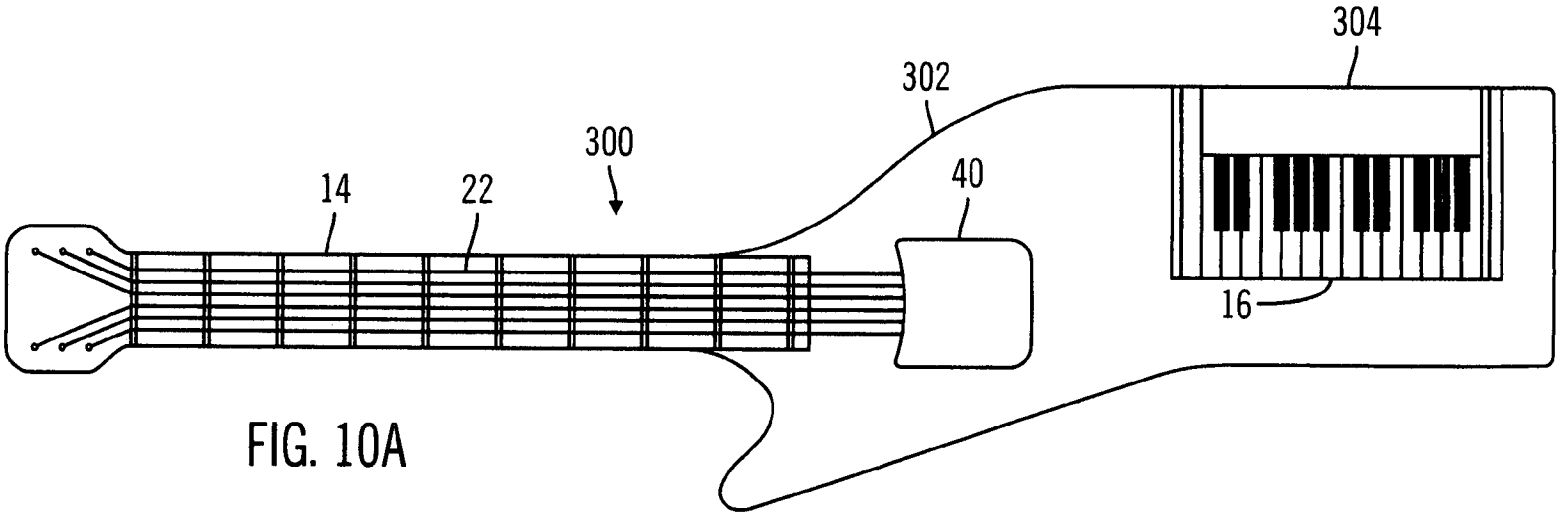
Figure 10B:
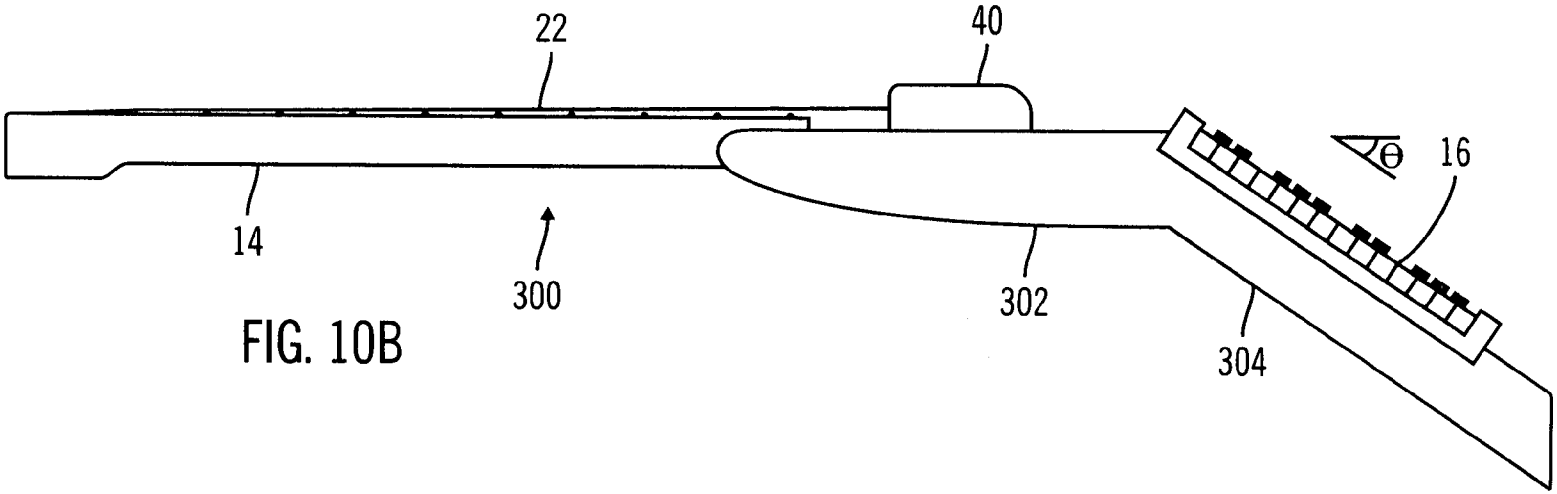

Referring now to FIGS. 10*a-b*, musical instrument 300 includes body 302, neck 14, strings 22, protective cover 40, and angled body extension 304. Angled body extension 304, though substantially flat, extends at an angle θ from body 302. Keyboard 16 is incorporated into angled body extension 304 in any desired manner described herein.

Figure 11A:
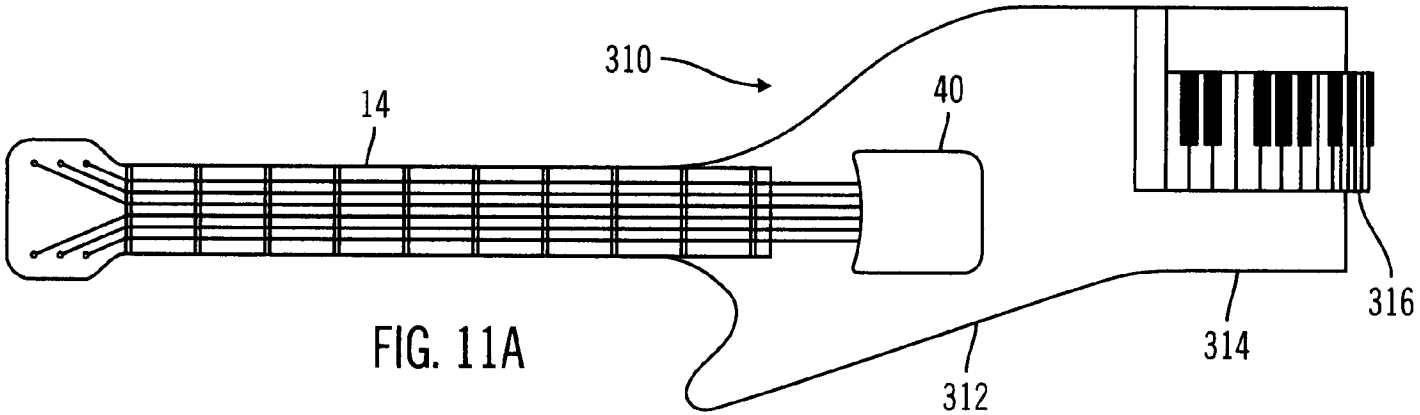
Figure 11B:
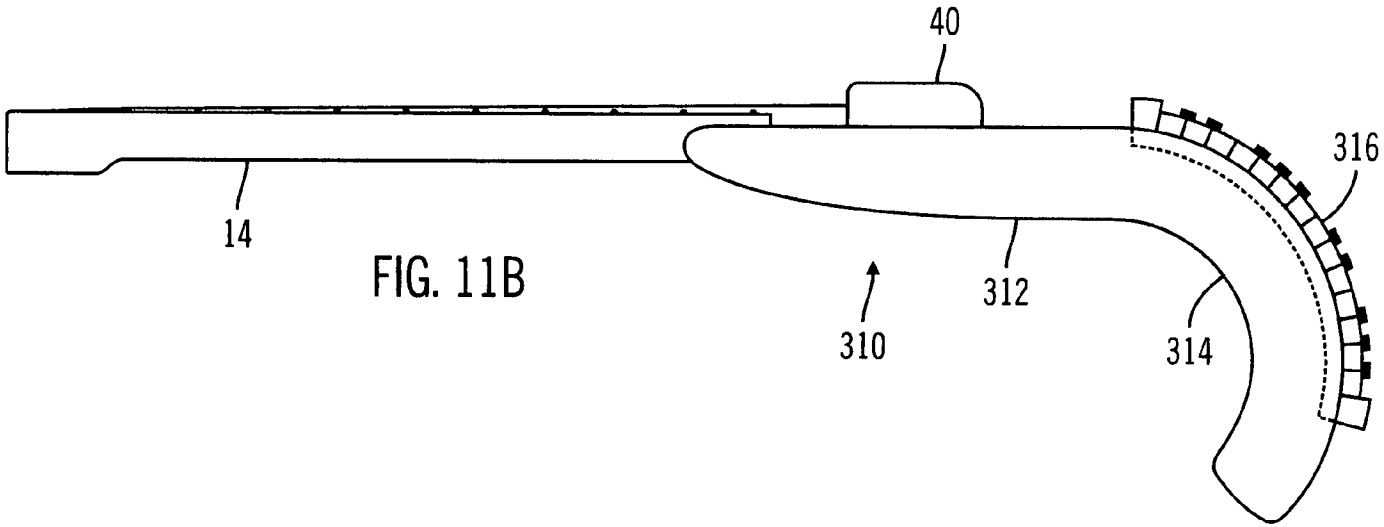

In FIGS. 11*a-b* musical instrument 310 includes neck 14, body 312, and curved body extension 314. Curved body extension 314 in the illustrated embodiment blends with body 312 to create a continuous form having a cross-section reminiscent of, e.g., the letter "J". Curved body extension 314 need not have a semi-circular cross-section, however; any desired curved shape, e.g., concave with varying radius of curvature, having one or more points of inflection, having curvature in more than one dimension, etc., can be utilized according to the invention, and all such shapes are contemplated as being within the scope of the invention. Curved keyboard 316 in such embodiments is advantageously a flexible keyboard that is secured to the surface of curved body extension 314, although, again, curved keyboard 316 can be secured to or incorporated into curved body extension 314 in any desired way.

Figure 12A:
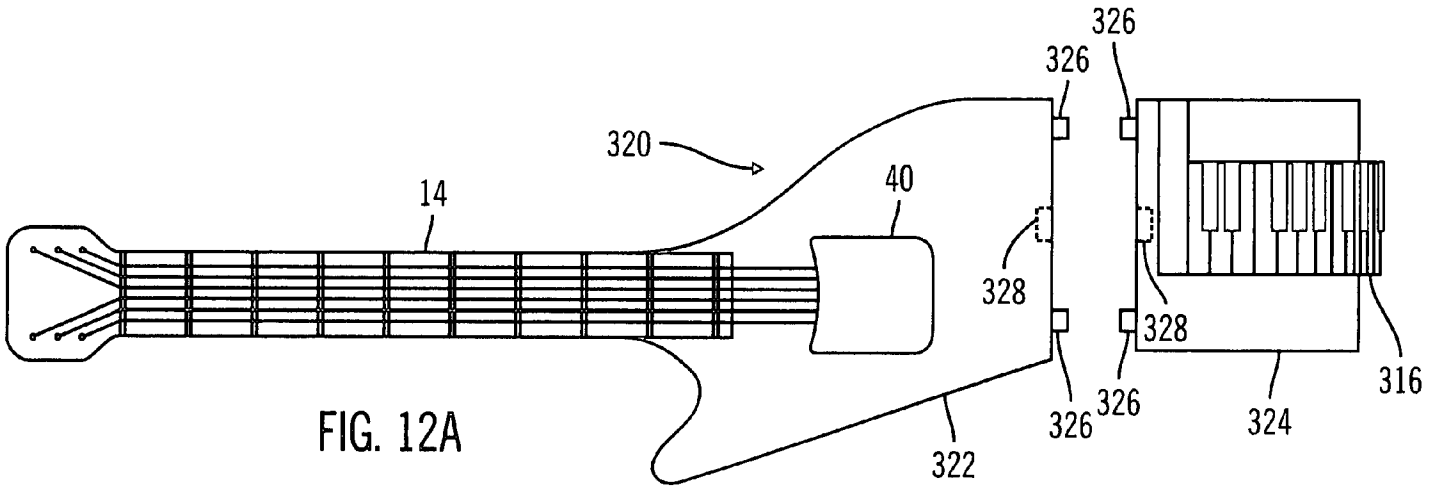
Figure 12B:
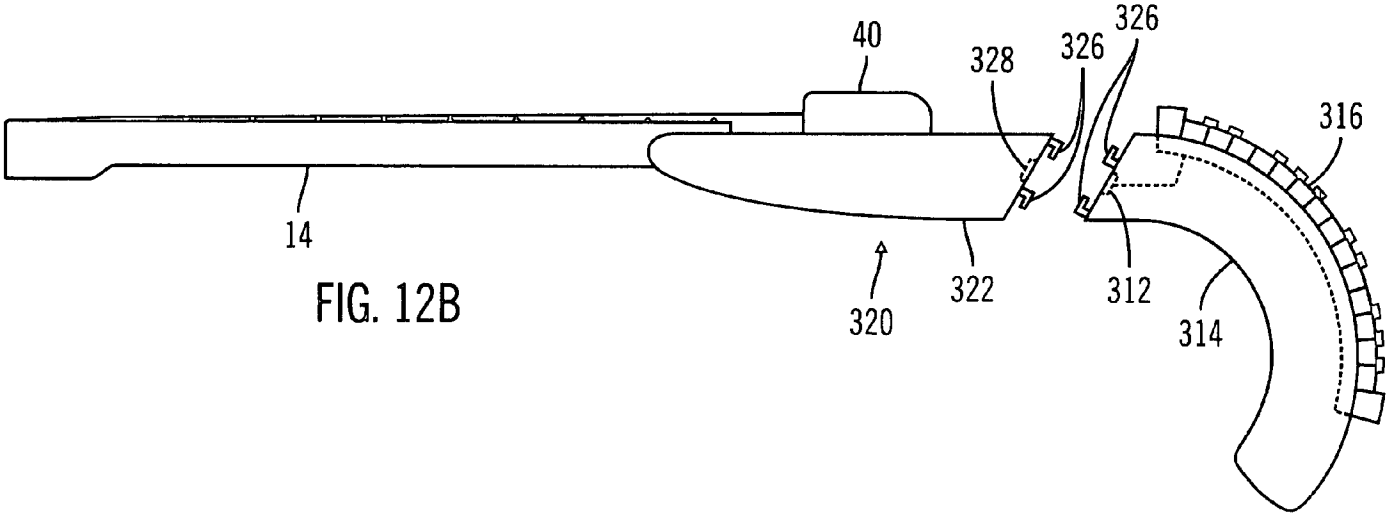

Referring to FIGS. 12*a-b*, an alternative configuration 320 of the embodiment of FIGS. 11*a-b* includes neck 14, body 322 and detachable curved body extension 324, to which curved keyboard 316 is secured. Detachable curved body extension 324 is secured to body 322 by connectors 326, which can be any desired conventional connecting elements. Contacts 328 facilitate communication between curved keyboard 316 and the remainder of instrument 320.

Detachable embodiments such as the foregoing provide advantages such as ease of manufacture, storage and transportation. Furthermore, if desired, musical instrument 320 can be played without detachable curved body extension 324, i.e., as a conventional stringed instrument without incorporated keyboard.

Figure 13A:
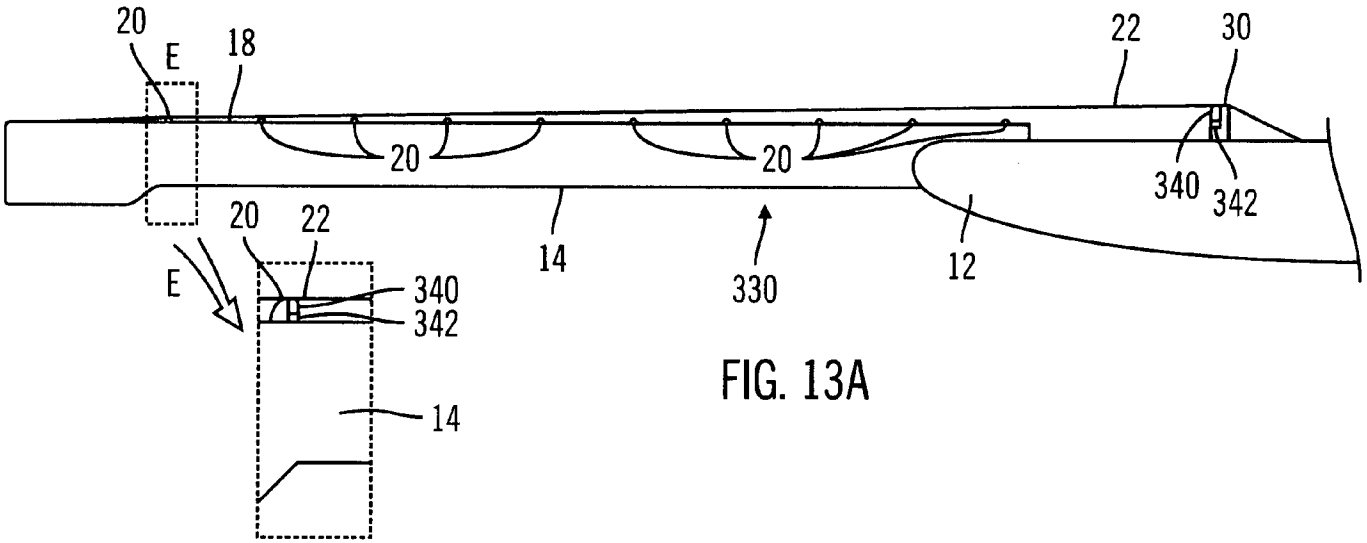
FIGS. 13*a-b* and 14 illustrate embodiments of musical instruments according to the invention including fingerboard configurations that facilitate the identification of string played by a user and provide information useful in implementing various functions that require such identification.
Figure 13B:
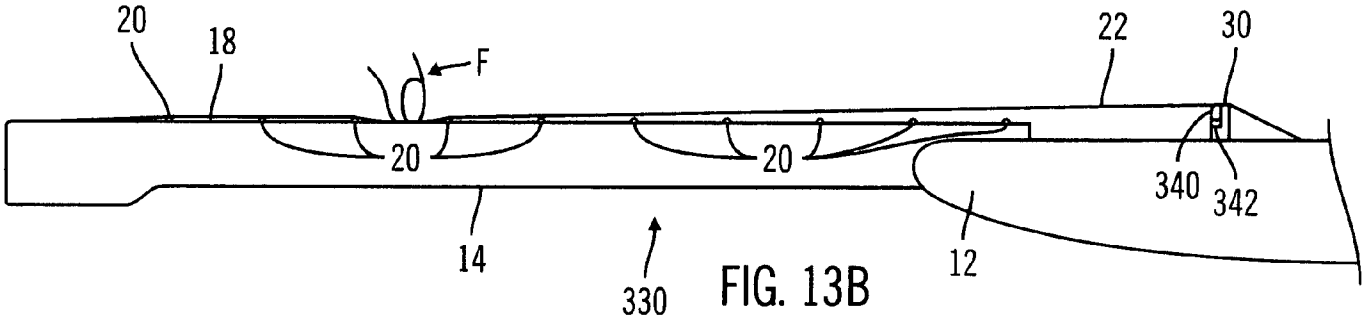

Additional embodiments of musical instruments according to the invention incorporate elements that facilitate identification of the string(s) played by a user. Referring to FIGS. 13*a-b*, instrument 330 includes body 12, neck 14, fingerboard 18 secured to neck 14, a plurality of frets 20 secured to fingerboard 18, a plurality of strings 22, and bridge 30 as in previous embodiments. Each string 22 is associated with paired emitters 340 and receivers 342, with one emitter and one receiver mounted adjacent each end of each string 22. For example, one emitter 340 and one receiver 342 are mounted, in one particular embodiment, in bridge 30, while a second emitter/receiver pair is mounted in a first fret 20 (as shown in enlarged section E-E'), or in another element secured to neck 14 or fingerboard 18. In more particular embodiments, each emitter receiver 342 in turn communicates with processor 32, and provides information to processor 32 concerning the radiation received from emitter 340, specifically the time at which emissions from emitter 340 are interrupted and/or resumed. In alternative particular embodiments, receivers 342 include processing elements configured to process such information and communicate results of such processing to processor 32.

Each emitter 340 emits radiation, for example laser light having a desired frequency. The emitted radiation is detected by receiver 342. Thus, two anti-parallel beams of radiation are emitted, each beam being emitted in a direction substantially parallel to its associated string. Further, receiver 342 detects the interruption of radiation emission from opposing emitter 340 at the opposite end of string 22, and, in particular embodiments, provides information pertaining to such interruptions (such as the time of the interruption) to processor 32. Alternatively, receiver 342 processes the information and in turn communicates the results of such processing to processor 32.

In use (see FIG. 13*b*), a player's finger F fingers string 22, for example between two frets as shown. Finger F interrupts the light emitted from emitters 340. The interruption of emissions from emitters 340 at each end of string 22 is detected by the opposed receiver 342. The time of each interruption is determined, by processor 32 or by other processing means, and the two times are compared. The difference between the times of interruption of emission from each of the two emitters 340 yields position information pertaining to the point at which finger F contacts fret board 18, and in particular whether any specific string 22 is fingered and where along fret board 18 such string 22 is fingered. This information is then available for use, for example, in implementing arpeggiation patterns or other functions in which such information is required.

Figure 14:
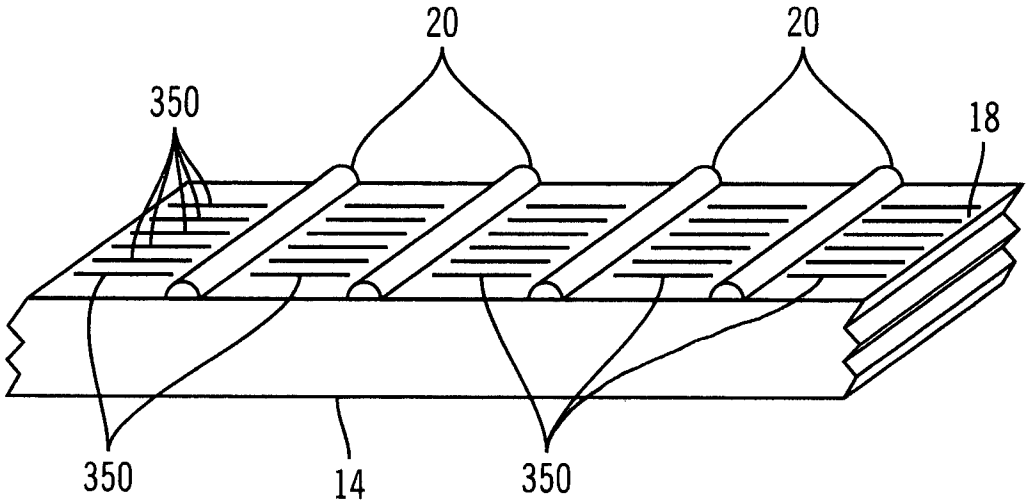

In FIG. 14, an alternative embodiment incorporates a plurality of touch sensors 350 associated with each string 22 and in communication with processor 32. Sensors 350 are placed, for example, between each fret 20 secured to fret board 18, and at any other desired locations along fret board 18. When a user fingers a string 22, the user's finger contacts a sensor 350 at the location at which string 22 is fingered. This information in turn is provided to processor 32 for use in various functions that require such information.

Embodiments of musical instruments according to the invention afford novel performance options to a player. For example, an off-stage performer can provide instructions to a two-neck "virtual string" embodiment such that the on-stage performer plays one neck of the instrument, and optionally the instrument's keyboard (physical or virtual), while the off-stage performer activates the second neck and thus produces an accompanying performance. In the same vein, an audience member can be enabled (e.g., via a telecommunications device) to activate the pluckers of an embodiment of a musical instrument of the invention and thus to strum one or more strings of the instrument which are fingered by the on-stage performer.

We claim:

1. A musical instrument comprising:

a) a body, the body comprising an extension, b) a neck attached to the body, the neck defining an axis, the neck and body defining a first plane, wherein a second plane is defined that is substantially perpendicular to the first plane, passes through the first plane and contains the axis, and wherein the extension comprises at least a portion that is non-coplanar with the first plane and has a cross-section that is at least partially contained in the second plane, c) a plurality of strings having first ends secured to the body and second ends secured to the neck, d) a plurality of pluckers, each string being associated with at least one plucker, e) a processor in communication with the plurality of pluckers, f) a control device in communication with the processor, the control device providing a signal to the processor whereby at least one of the plurality of pluckers is activated, thereby plucking the string associated with the at least one plucker to produce a musical note, and g) a keyboard secured to the body such that at least a portion of the keyboard is secured to the non-coplanar portion of the extension, the keyboard comprising a plurality of keys for producing sounds, the musical notes produced by the pluckers activated by control device f) and the sounds produced by the keys of keyboard g) being produceable substantially simultaneously.

2. The musical instrument of claim 1 wherein the neck comprises a fret board comprising a plurality of sensors in a number sufficient to detect a fingering of a plurality of notes playable on the fret board.

3. The musical instrument of claim 2 wherein the sensors are touch sensors.

4. The musical instrument of claim 1 wherein the processor is in communication with the keyboard.

5. The musical instrument of claim 1 wherein the control device comprises a foot pedal.

6. The musical instrument of claim 1 wherein the control device comprises a touch-sensitive neck insert.

7. The musical instrument of claim 1 wherein the keyboard comprises a control that enables an arpeggiation pattern to be produced by the activation of a specified group of pluckers in a specified order when a key of the keyboard is depressed.

8. The musical instrument of claim 1 wherein the body comprises a lower surface, and wherein the non-coplanar portion of the extension extends away from the lower surface of the body.

9. The musical instrument of claim 1 wherein the extension is detachable.

10. The musical instrument of claim 8 wherein the non-coplanar portion of the extension has a cross-section in a third plane that forms an acute angle with the first plane.

11. The musical instrument of claim 10 wherein the non-coplanar portion of the extension is curved.

12. A musical instrument comprising:

a) a body, the body comprising a lower surface, the body further comprising a curved extension, b) a neck attached to the body, the neck defining an axis, the neck and body defining a first plane, wherein a second plane is defined that is substantially perpendicular to the first plane, passes through the first plane and contains the axis, and wherein the curved extension comprises at least a portion that is non-coplanar with the first plane, extends away from the lower surface of the body and has a cross-section that is at least partially contained in the second plane, c) a plurality of strings having first ends secured to the body and second ends secured to the neck, d) a plurality of pluckers, each string being associated with at least one plucker, e) a processor in communication with the plurality of pluckers, f) a control device in communication with the processor, the control device providing a signal to the processor whereby at least one of the plurality of pluckers is activated, thereby plucking the string associated with the at least one plucker to produce a musical note, and g) a keyboard secured to the body, the keyboard such that at least a portion of the keyboard is secured to the non-coplanar portion of the extension, the keyboard comprising a plurality of keys for producing sounds, the musical notes produced by the pluckers activated by control device f) and the sounds produced by the keys of keyboard g) being produceable substantially simultaneously.

13. The musical instrument of claim 12 wherein the curved extension is detachable.

14. A musical instrument comprising:

a) a body, the body comprising a lower surface, the body further comprising an extension, b) a neck attached to the body, the neck defining an axis, the neck and body defining a first plane, wherein a second plane is defined that forms an acute angle with the first plane, and wherein the extension comprises at least a portion that is non-coplanar with the first plane, extends away from the lower surface of the body and has a cross-section that is at least partially contained in the second plane, c) a plurality of strings having first ends secured to the body and second ends secured to the neck, d) a plurality of pluckers, each string being associated with at least one plucker, e) a processor in communication with the plurality of pluckers, f) a control device in communication with the processor, the control device providing a signal to the processor whereby at least one of the plurality of pluckers is activated, thereby plucking the string associated with the at least one plucker to produce a musical note, and g) a keyboard secured to the body, the keyboard such that at least a portion of the keyboard is secured to the non-coplanar portion of the extension, the keyboard comprising a plurality of keys for producing sounds, the musical notes produced in step f) and the sounds produced in step g) being produceable substantially simultaneously.

15. The musical instrument of claim 14 wherein the extension is detachable.

* * * * *